United States Patent [19]

Ryan

[11] Patent Number: 4,936,735

[45] Date of Patent: Jun. 26, 1990

[54] INTEGRATED MODULAR PORTABLE MAIL TRAY DELIVERY SYSTEM AND COMPONENTS

[75] Inventor: Patrick J. Ryan, Reseda, Calif.

[73] Assignee: Alpha Mail System, South Pasadena, Calif.

[21] Appl. No.: 340,026

[22] Filed: Apr. 18, 1989

Related U.S. Application Data

[62] Division of Ser. No. 143,647, Jan. 13, 1988, Pat. No. 4,889,397.

[51] Int. Cl.[5] ..... B60P 1/64

[52] U.S. Cl. ..... 414/679; 211/1.5; 211/11; 211/50; 414/498

[58] Field of Search ..... 414/498, 679, 507, 499, 414/522, 528, 349, 573; 312/330 R, 193, 286, 263, 320, 312, 138 R; 209/702, 703; 211/11, 50, 45, 1.5, 184

[56] References Cited

U.S. PATENT DOCUMENTS

| | | | |
|---|---|---|---|
| 806,965 | 12/1905 | Field | 312/312 X |
| 1,030,317 | 6/1912 | Middaugh | 211/11 X |
| 1,204,271 | 11/1916 | Greene | 414/522 |
| 1,206,169 | 11/1916 | Talbot | 414/528 |
| 3,221,912 | 12/0019 | McWilliams | 414/679 X |
| 3,747,752 | 7/1973 | Reader | 209/546 |
| 3,747,752 | 7/1973 | Reader | 209/546 |
| 4,051,969 | 10/1977 | Homanick | 414/679 |
| 4,484,685 | 11/1984 | Williams | 209/703 |
| 4,545,710 | 10/1985 | Hepp | 414/498 X |
| 4,643,306 | 2/1987 | Ryan | 211/50 X |

*Primary Examiner*—David A. Bucci

[57] ABSTRACT

A mail delivery system including, a plurality of portable trays each tray having a bottom, an open top, at least two rigid oppositely disposed sides affixed to the bottom, at least one open side, a gate member to open and close the open side. Separators removably attached to at least the bottom. Regularly spaced slots within the bottom to receive the separators. At least one set of handle members to assist in the transportation of the portable tray and to assist in the withdrawal or insertion of the portable tray from holder members arranged to receive the tray. A tray case containing a plurality of holder members to removably receive a plurality of the portable trays, members for raising and lowering the case and the trays from a loading position to a sorting position. A transport member containing a plurality of holder members to receive the portable trays and transport the portable trays from the tray cases to a tray rack in a delivery vehicle.

5 Claims, 12 Drawing Sheets

INTEGRATED MODULAR PORTABLE MAIL TRAY DELIVERY SYSTEM AND COMPONENTS

This application is a divisional of copending application Ser. No. 07/143,647, filed on Jan. 13, 1988, now U.S. Pat. No. 4,887,397.

BACKGROUND OF THE INVENTION

1. Field of the Invention

This invention relates to a system and components for sorting, carrying and assisting in the delivery of mail or similar materials. In particular, the invention relates to a modular portable mail delivery sorting tray with a movable mail retention gate which can be used to sort the mail and then transport it to a delivery means. Further, the invention particularly relates to the improved system where the delivery means is provided with a plurality of holding means to hold a plurality of the modular trays so that they can be moved by an operator from a storage area within the delivery means to the operator and returned to the storage area.

2. Description of Related Art

The collection distribution and delivery of mail is a complex and labor intensive job. In recent years, the United States Postal System has received competition from special letter messenger services, such as Federal Express, UPS, Purolator, DHL and the like. All of these mail delivery systems are faced with the same problems of collecting the mail, shipping it to the city of destination, and distributing the mail to the ultimate patron. Each of these services are faced with the same problems of sorting the mail for distribution. Finally, each is faced with the problem of having their particular carrier sort and arrange the mail for efficient delivery to the postal patrons. Over the years, many schemes and systems have been suggested or devised for the sorting and distribution of mail at each level. The present invention is directed to a system and components for that system for the final sorting and arrangement of the mail in the most efficient manner for distribution to the postal patrons.

At present, the United States Postal Service has the individual postal delivery person prepare and arrange the mail for final delivery. The postal employee receives mail for the route and then sorts the mail by manually inserting the separate articles of mail into pigeon holes formed within a cabinet. This cabinet is mounted in a fixed location within the post office. Each pigeon hole contains appropriate identifying indicia to denote the particular postal patron. The names of the postal patrons are arranged in an order so that once out on the route, the delivery person may efficiently accomplish mail delivery. Under the present system, it is common to have small parcels and flat mail (magazines, newspapers and the like) sorted separately.

After the mail has been sorted, it is removed from the pigeon holes, wrapped in rubber bands and stacked in order in an unpartitioned plastic bin or delivery tray. These trays are transported to a vehicle and taken out on the delivery route.

The operation of sorting the mail into the pigeon holes is referred to as casing the mail. The standard casing cabinet has several shelves and many dividers. The time necessary for the carrier to "case" the mail by sorting it into the cabinet, rubber banding it and stacking it in order within the undivided bins is all counted in the time of delivery which is a factor considered by the U.S. Postal Service in determining efficiency of both the delivery person and the operating postal system. This present system requires handling the mail many times. In what is called a "checking operation" the mail is sorted and grouped and resorted and resorted and regrouped checking the address each time.

On the route, mail is hand held and fingered or checked through to separate one address from the next. As each group of letters is separated for delivery to the patron, it is necessary to finger through the remaining mail for the group of mail to be delivered to the next patron. Further, it is necessary to search separately through the flat mail consisting of magazines, newspapers and the like to deliver that separately held mail to the postal patron. Under the present system, flat mail is not held with letter mail.

In my own prior invention described in U.S. Pat. No. 4,643,306 (hereinafter '306), a postal tray is described and claimed which is used for both sorting the mail and for delivery to the postal patron. In the invention in my prior patent, the letter mail is sorted directly into the postal tray and the postal tray is carried directly to a vehicle for transportation to the postal patron's location. Mail is removed from its slot in the postal tray and directly delivered to the patron. The postal tray eliminates the need for constant fingering and for rubber banding of the mail. Because of the placement of the mail retention bar in my prior invention, the tray is not adaptable for the handling of both flat mail and letter mail in an integrated system.

A similar system to the system described in my own prior patent, the '306 patent, is described in U.S. Pat. No. 3,885,668 (hereinafter '668). In U.S. Pat. No. '668, removable trays are mounted in the equivalent casing cabinets. Once the mail is sorted the tray is carried to a vehicle and stacked, mail is removed from the tray only for delivery to the patron. The tray as described in U.S. Pat. No. '668 utilizes a band-across-the-top method of holding mail which is inefficient and clumsy allowing mail of smaller than the largest piece in the tray to slide out. These trays are not particularly suitable for an integrated delivery system in which flat and letter mail are handled together. Other sorting cabinets with removable trays have been suggested over the years as taught by U.S. Pat. No. 1,030,317 in which a removable bar across the front of the tray also removes the vertical separators to supposedly facilitate the binding of mail.

Casing cabinets in which the shelves or the cabinets can be raised or lowered to either facilitate the sorting of mail or to enlarge the space needed to sort mail have been suggested by Cobb in U.S. Pat. No. 1,366,401 and by Field in U.S. Pat. No. 806,965.

Talbot in U.S. Pat. No. 1,206,169 described what is essentially a travelling post office. A rural delivery van is equipped with several endless conveyors containing receptacles of several different types. Mail is sorted into the different receptacles depending upon its particular type. Therefore, flat mail, such as magazines, are put in one holder and letter mail in another and packages in yet a third. The carrier rotates the conveyors and removes the appropriate mail from its appropriate bins when at a patrons location. Greene in U.S. Pat. No. 1,204,271 describes a delivery van equipped with bins which slide upon tracks.

A mail delivery system is disclosed in Long, U.S. Pat. No. 1,316,586, which describes a flexible sorting case made out of a fabric material which is hung on a rack in the post office for the casing (sorting) of the mail. After the mail is sorted the flexible holder or case is carried out to a mail delivery vehicle spread out on the appropriate seat and used to assist in the delivery of mail.

Bakken in U.S. Pat. No. 833,110 describes a system wherein mail is sorted into a shelf arrangement. The shelf arrangement contains separators which create individual compartments. When the mail has been sorted into this shelf, the shelf is carried out to the mail delivery vehicle and placed into a holder box. The mail is then delivered from this shelf arrangement to the postal patron.

Reader in two issued U.S. patents and in an abandoned application referred to in at least one of the above-mentioned patents, shows a system and apparatus for delivering mail to gang mail boxes. In U.S. Pat. No. 3,747,752 to Reader, Reader discloses a mail delivery box arrangement is disclosed which receives the sorted mail. The box arrangement is then taken to a gang mail box and inserted into the mail box. When the mail box door is closed each individual compartment of the gang mail box becomes the mail receptacle for a particular patron. Reader in U.S. Pat. No. 3,732,978 shows a cloth version of such a mail distribution systems. In abandoned U.S. application Ser. No. 209,206, filed Dec. 17, 1971, referred to in column 1 of Reader patent '978, a system is disclosed in which the gang mail boxes are removable parts of a cart arrangement. It is anticipated by Reader that the cart would be taken to a office building or apartment complex and mail would be delivered to the patron from the cart.

SUMMARY OF THE INVENTION

Accordingly, it is a primary object of the present invention to provide an integrated system for the rapid and efficient sorting and delivery of mail to postal patrons. Further, it is an object of this invention to provide improved components including rolling tables or carts for sorting mail, improved cases or cabinets for sorting mail, improved means of transporting mail from the casing cabinets to delivery vehicles and improved delivery vehicles all integrated and centered about a modular portable postal tray.

An additional object of this invention is to provide an improved postal tray which contains variable size bins and an improved gate mechanism which can retain the mail in the tray when in a raised position and not interfere with sorting the mail when in a lowered position. Yet another object of this invention is to provide an improved delivery vehicle which contains a track mechanism which carries a plurality of the modular portable trays in such a manner that the trays can be rapidly moved from the storage compartment of the delivery vehicle to the operating area of the delivery vehicle and to thereby increase speed and reduce the amount of turning, bending and extraneous movement required of the delivery person.

These and other objects of the present invention are fulfilled by providing a mail delivery system which has a plurality of modular portable trays. Each tray has a bottom, an open top and at least two rigid oppositely disposed, upwardly projecting sides attached to the bottom. The tray also has at least one open side. The side opposite the open side can either be another open side or more preferably a rigid upwardly projecting side. The open side contains a gate means arranged to open and close the open side. Separators are removably attached to at least the bottom of the portable tray. Preferably regularly spaced slots in the bottom of the tray receive the separators. The tray contains at least one set of handle means to assist in the transportation of said portable tray and to assist in the withdrawal or insertion of the portable tray into holder means in the other system components. The tray includes slides which serve as an alignment means as well as a locking device for receiving the tray to the holder means.

The handle contains a groove or track having an upper retention position and a lower storage position. The lower storage position is substantially at or below the bottom of the tray. A gate is disposed within the groove. The gate is movable between the upper retention position and a lower storage position. Selectively, the gate provides access for mail sorting through the open side when the gate is in the storage position and the gate prevents items held in the tray from accidentally falling out of the open side when the gate is in the upper retention position.

The second component of the system is a tray case which contains a plurality of holder means. The holder means are arranged to removably receive the portable trays. The tray case has a means for raising and lowering the case so that the trays can be placed at an ideal height for loading and unloading. Ideally, the tray case has a loading position for removing and inserting the portable trays and a raised sorting position for sorting mail.

An additional part of the system is a transport means to receive the portable trays from the tray case arrangement and transport the trays to a tray rack in a delivery means or vehicle.

A delivery means or vehicle includes a control center occupied by the delivery person and a storage center. Of course the vehicle includes a propulsion means and the other attributes of a vehicle. The improvement in the delivery means for the present system includes a track means communicating with the control and storage centers. At least one tray rack is mounted on a moving means on the track. Each tray rack contains a plurality of holder means which are adapted to removably receive more than one of the portable trays preferably each tray rack will contain at least three trays. The moving means is attached to the tray rack and movably mounted on the track to permit the tray racks to be moved from a loading position to a storage position in the storage center and to a delivery position in the control center. A stop means is also provided to releasably hold each one of the tray racks at any desired position in the track means. The delivery means is also provided with an access means such as doors in the storage center to facilitate the loading and unloading of the portable trays from the tray rack. The loading position of the track is adjacent to the access means.

Additionally, the system can include an improved casing cart to fit against or near the sorting tray case. The casing cart is used to assist in sorting and casing mail by providing a table top for sorting the mail and carrying capacity for the raw mail. The casing cart is dimension to form a ledge arrangement when the sorting tray case is in the raised or sorting position. Further, the system can include a collapsible cart adapted to transport a plurality of the portable trays by mounting a holder frame upon the cart.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF PREFERRED EMBODIMENTS

Figure 1:
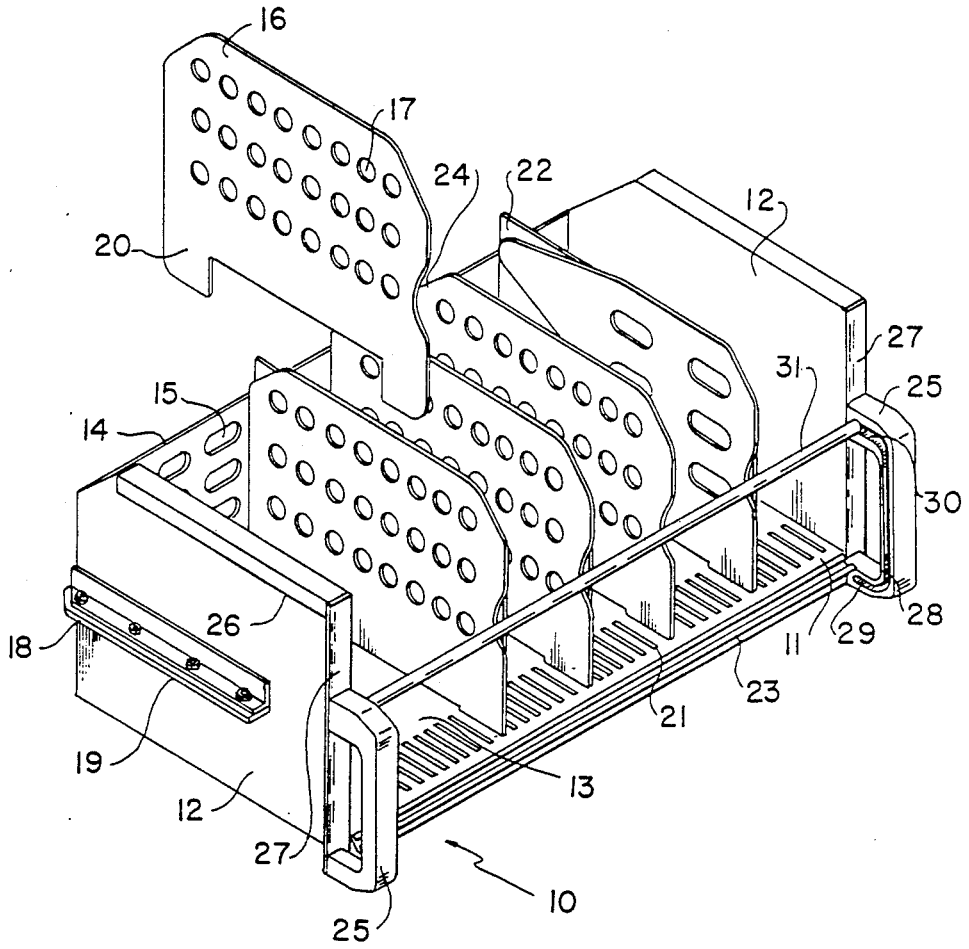
FIG. 1 is a perspective view of the improved postal tray of the present invention.
Figure 2:
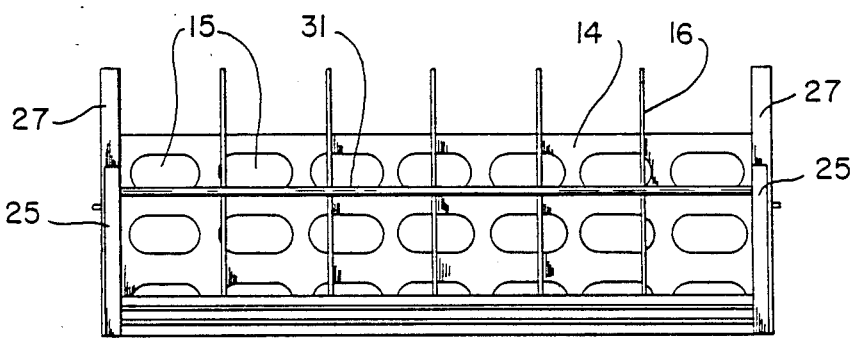
FIG. 2 is a front elevation view of the improved postal tray of the present invention.
Figure 3:
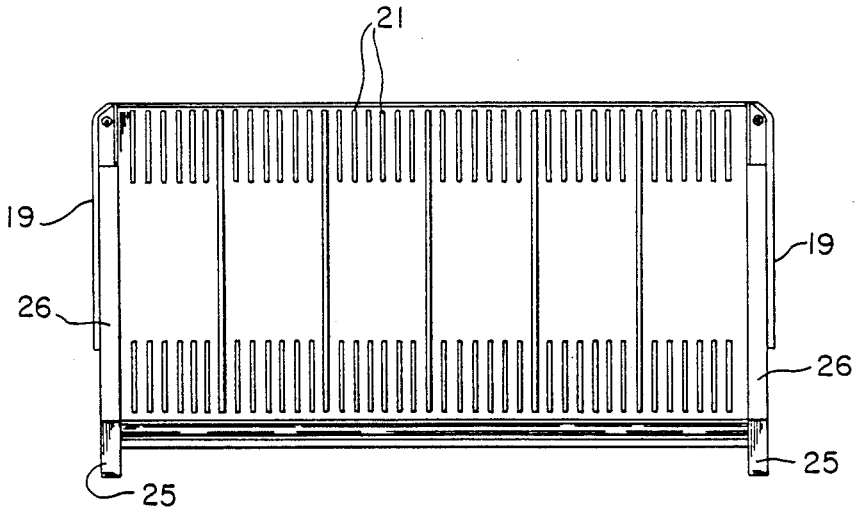
FIG. 3 is a top view of the postal tray of the present invention showing the slots for retention of the separators.
Figure 4:
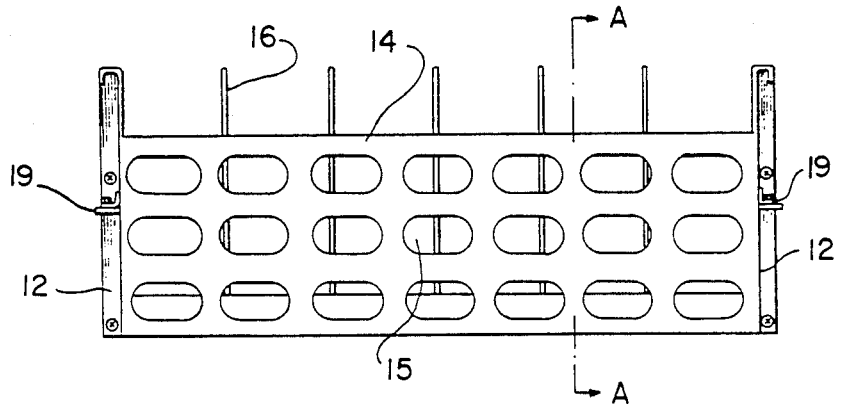
FIG. 4 is a back view of an embodiment of the postal tray of the present invention wherein the back is closed.
Figure 5:
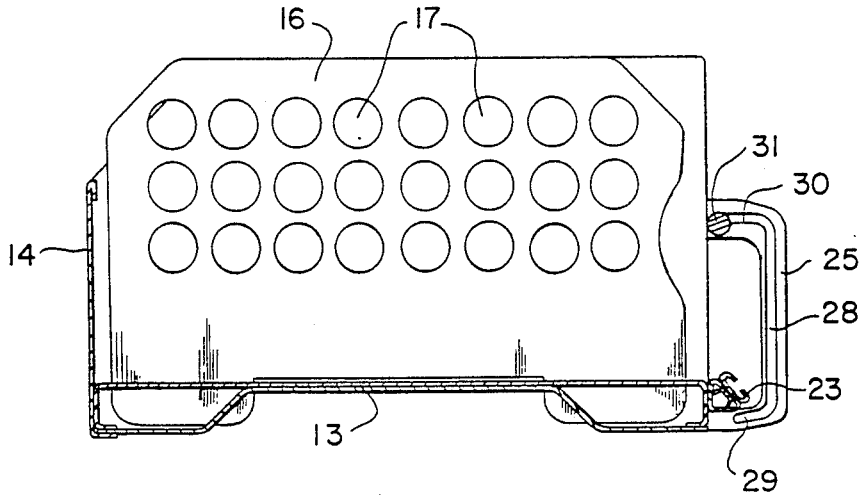
FIG. 5 is sectional view through the postal tray of the present invention taken along line A of FIG. 4, showing a separator of the present invention.

Referring particularly to the drawings, FIGS. 1–5 illustrate a postal tray 10 of the present invention which is a box-like configuration having a planar bottom 11, at least two rigid oppositely disposed upright sides 12, at least one open side designated generally by the number 13 and in the preferred embodiment a rigid back side 14. The back side is of similar structure to the opposite sides 12, but in its preferred embodiment is pierced by holes 15 in order to lighten the general weight of the tray. The sides 12, 14 and open side 13 define a space between the inner walls. This space is subdivided by separators 16. The separators can be of any construction usually used in lateral office file cabinets or the like. It is preferred that the separators 16 are pierced by holes 17 to again lighten the total weight of the portable tray. An L-shaped slide bracket 18 is attached to the outside of the oppositely disposed end walls or side walls 12 of the portable tray. The bottom of the slide bracket 18 is provided with a slide substance such as Teflon, polyethylene or the like. It is preferred that this be in the form of a slide bar 19.

The bottom 11 of the tray 10 is provided with two sets of slots 21 which cooperate with tabs 20 on the separators 16 to cause the separator 16 to stand in a rigid manner. The separators 16 in conjunction with each other or with the side walls 12 or the back wall 14 define pockets which will hold the mail. In an ideal situation, one pocket will be provided for each postal patron. In some circumstances, it may be desirable to further subdivide the pockets. This further subdivision can be done by a plastic separator such is shown at 22 which is loosely inserted to further subdivide the space. In the preferred embodiment, the slots 21 are spaced approximately one-half an inch apart in two parallel rows cooperating with the tabs 20. The spacing of the slots 21 in the bottom 11 of the tray 10 allows for flexibility to establish each pocket at varying widths depending on the normal or expected volume of mail, papers, envelopes or the like for each delivery. The separators 16 are constructed of a flexible material which will permit a pocket to be overfilled when the need arises.

An indicator strip 23 is provided at the front edge of the box-like structure to be able to put code numbers or names or addresses to designate the individual mail recipient. The indicator strip 23 can be mounted flush, straight up and down. In the alternative, the indicator strip 23 may be positioned at an angle for better visibility. The separator 16 are provided with a finger space or notch 24 to facilitate handling the mail. The tray 10 is designed to allow flexibility of providing for one bundle system. In the alternative, the tray 10 may be used for letters, papers, magazines, small parcels or the like.

To further describe the novel portable postal tray of the present invention, the open side of the tray is designated the front. The rigid wall 14 of the longer dimension of the tray is designated the back and the sides 12 are designated left and right as one views the tray from the open side. Each side 12 has an upper portion which defines an open top for the tray. A forward portion which is toward the open front 13 of the tray and a bottom portion which is attached to the bottom 11 of the tray 10 of this invention. The forward or front edge of the sides 12 are designated 27.

In the preferred embodiment, the tray is constructed of a lightweight strong metal material. Steel, aluminum alloys or other metals are contemplated as construction materials for the present invention. It is also contemplated that strengthened plastic materials and carbon materials which are now or will in the near future be fully developed and commercially available could also be used for construction materials for this invention.

A pair of handle means 25 are attached to the front edge 27 of the sides 12. Each of the handle means 25 contain a groove 28 which follows the shape of the handle. The groove 28 has a lower widened portion 29 which acts as a storage position and an upper notch 30 which is designated as a retention position. A gate 31 is mounted within the grooves 28 so that it can be slidably moved from the storage position to the retention position. It is preferred that the storage position 29 is below the upper surface of the bottom 11 so that when the gate 31 is in the storage position, the gate 31 permits the open front 13 of the tray to be completely unobstructed. The gate 31 can be in the form of a bar as shown in FIGS. 1–5, or it can be in the form of a folding screen material which will essentially close the open side when the gate is raised to the retention position. This would form a window shade type operation wherein a forward bar would include a screen or mesh material attached thereto which would ride in the groove 28. The height of the handle 30 and the extent to which the gate 31 is raised is not critical so long as the gate 31 and any trailing portions of the gate 31 are positioned to prevent mail from sliding or falling out of the open side of the portable tray 10 when the tray 10 is being carried or moved from one location to another or is positioned in a moving vehicle. The handle means 25 serves as both a handle and as a track for the gate 31.

As illustrated in FIGS. 1–5, the upper edges of the sides 12 are folded or rolled over to form a second handle means 26. This additional handle 26 provides another means of griping or holding the tray in the carrying position. Of course, the slide 19 can also function as a handle.

Figure 6A:
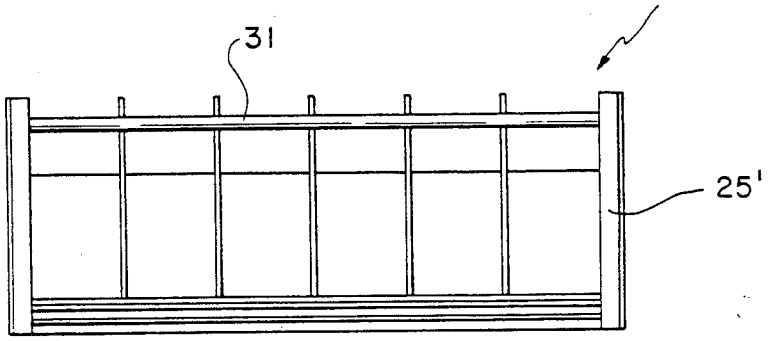
FIG. 6A is a front view of the postal tray of the present invention showing a second embodiment of a handle with the gate in the raised position.
Figure 6B:
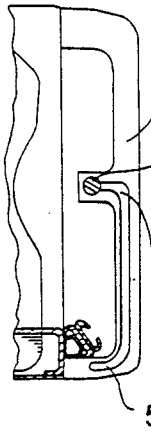
FIG. 6B is a side elevational view of the postal tray illustrated in FIG. 6A.

FIGS. 6A and 6B illustrate another embodiment of a postal tray 10' wherein the handle member 25' extends along substantially the entire height of the side walls 12'. A retention position 55' is provided at substantially the midpoint of the handle member 25'. A lower storage position 56' is disposed adjacent to the bottom 11'.

Figure 7:
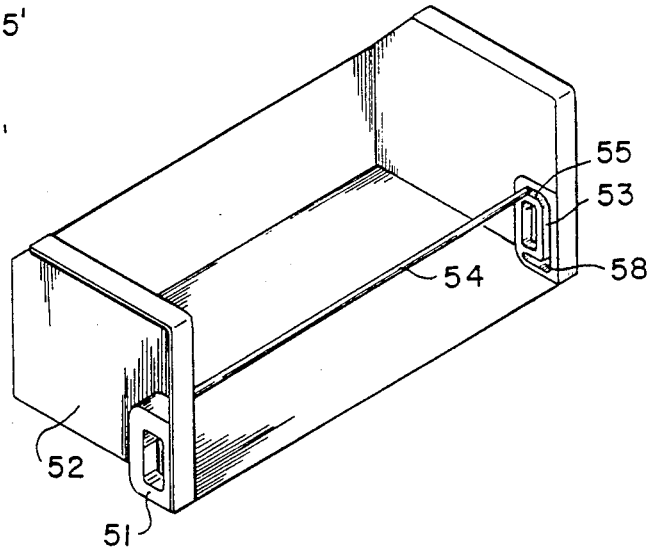
FIG. 7 is a perspective view of an alternate embodiment of the postal tray of the present invention showing the handles as a part of the side rather than an extension of the side.

The handle means 25 containing the gate means 31 does not have to be located on the outside of the front edge 27 of the portable tray 10. As illustrated in FIG. 7, a handle 51 may form a part of a side 52 of a portable tray having generally the same configuration and details as is shown in FIG. 1. The handle means would have a groove 53 and a gate or bar 54 which is slidably mounted in the groove 53. The groove includes an upper retention position 55 and a lower storage position 56. The storage position 56 should be in such a position that it does not provide any obstruction to the sorting and insertion of all types of mail when the bar 54 is in the storage position 56. The same requirement is true of the gate 31 as illustrated in FIG. 1.

Figure 8:
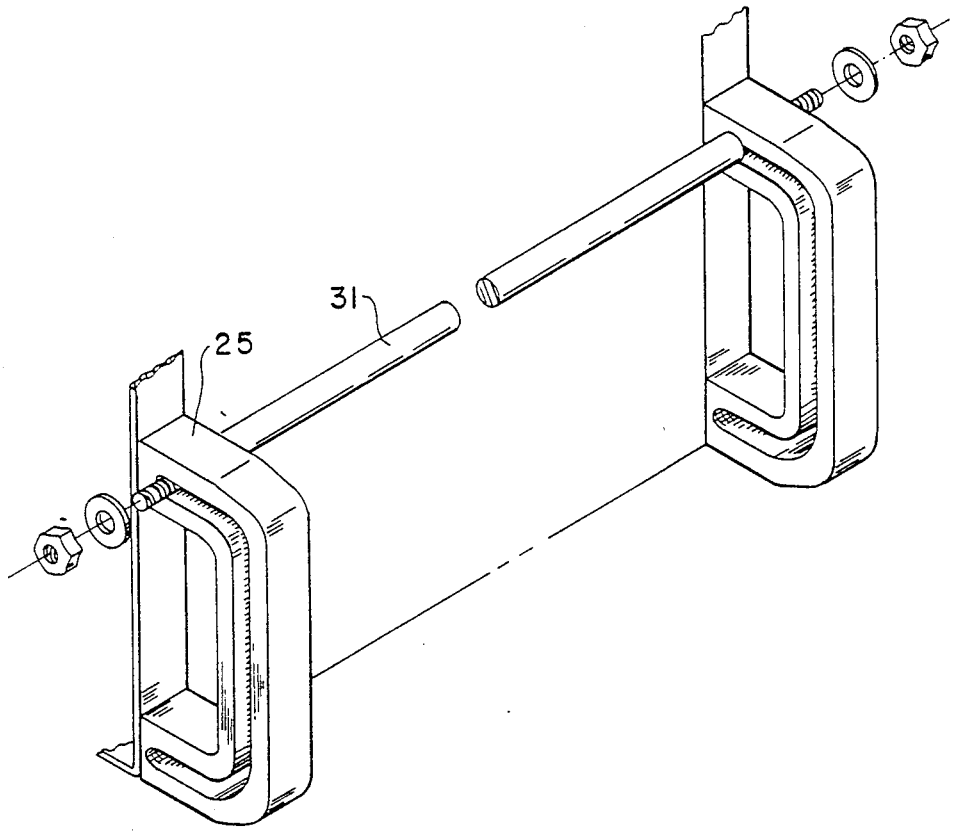
FIG. 8 is a detailed view of the handle of the present invention showing one means of attaching the gate means.

There are many ways in which the gate 31 can be mounted in the handles 25 and 51. The gate 31 can be formed as a bar having a reduced end sized to fit within the groove. The groove 28 can be cut partially through the handle 25 and the handle assembly attached to the tray 10 thereby locking the bar into place. In an alternative embodiment as illustrated in FIG. 8, the ends of the bar 31 can project through a groove cut completely through the handles 25. The ends of the groove can be threaded and locked in place by any one of a number of fasteners known for retaining a rod such as nuts, caps or the like.

The portable tray 10 is an important part of the total system. The tray 10 will be moved from one position to another so that once the mail is sorted into the tray the mail does not have to be handled again. As illustrated in FIG. 10, 11*a*, 11*b*, and 18, the system of the invention provides a single sorting tray case 60 or a double counterbalanced case 77. The tray case 60 includes parallel sides 61 into which an open single unit rectangular box arrangement 62 is mounted or two open double unit counter balanced units 75. The box arrangement includes a back wall 63, a bottom 64 and vertical, oppositely disposed sides 65. In the preferred embodiment an additional vertical member 66 is provided in the center dividing the tray case 60 into two vertical columns and serving as a guide if the double unit counter balanced case 77 is utilized. A plurality of holder means 67 are provided within the cabinets 62 and 75. The holder means 67 are designed with and provide a sliding support surface for the slides 19 positioned on the vertical sides 12 of the portable tray 10. In the preferred embodiment, the ten sets of the holder means 67 are provided in two columns of five sets each. The holder means 67 also includes a notch to hold the trays in place. The cabinet 62 may be slidably mounted within the vertical sides 61 above the base 68 or the separate units 75 supported adjacent vertical member 66, moving freely up and down between sides 61. The base 68 merely retains and holds the vertical sides 61 and vertical member 66 in a rigid manner.

A drive mechanism 70 is provided to move the case 62 and 75 up and down within the sides 61. In the embodiment illustrated in FIGS. 10, 11A and 11B, the drive mechanism 70 includes a worm screw 70A and motor 70B but it is also contemplated that counterbalancing weights, springs, hydraulic systems or the like can be used for raising and lowering the case. The cabinet 62 and 75 can be actuated by suitable control means (not illustrated) to move up and down so that each holder set 67 can be positioned to insert or remove a tray 10 without causing strain to the back of the delivery person. In the preferred embodiment, the entire cabinet 62 may be lowered to a lower position or each side 75 would be lowered individually in a counter balanced assembly such that the lower most shelf and the upper most shelf can be selectively positioned within the safety requirements for loading and unloading without causing undue back strain. The safety requirements can be those designated by physicians in the art or the specific requirements stated by the United States Postal Service.

Figure 11B:
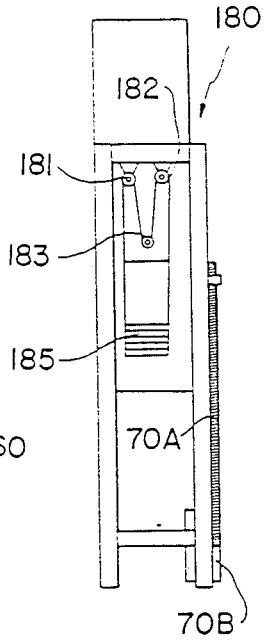
FIG. 11B is a side view of a tray case illustrating the counter weight balance assembly that may be used with the tray case illustrated in FIGS. 10 and 11A.
Figure 11A:
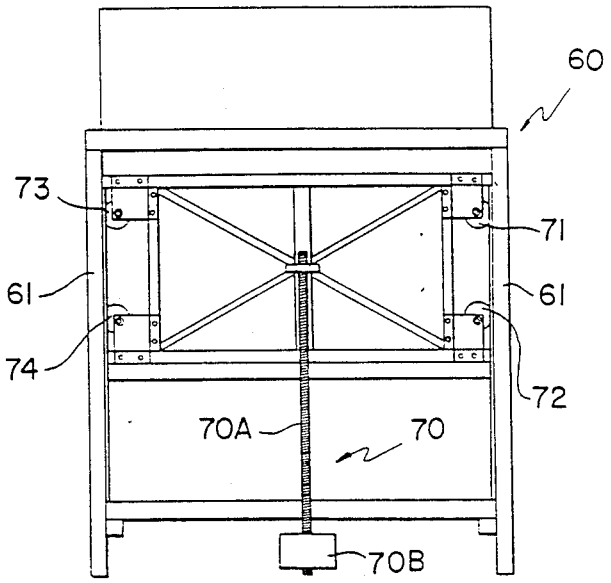
FIG. 11A is a back view of a tray case of the present invention showing a worm screw mechanism for raising and lowering the tray case.

As illustrated in FIG. 11A, the sorting tray case 60 includes a plurality of wheels 71, 72, 73 and 74 for guiding the movement of the sorting tray case 60 relative to the parallel sides 61. As illustrated in FIG. 11B, a counter weight assembly 180 is provided for maintaining a predetermined positioning of the single unit sorting tray case 60. The counter weight assembly 180 includes pulleys 181, 182 secured to the parallel sides 61 and a pulley 183 secured to the sorting tray case 60. A weight 185 maintains the positioning of the sorting tray case 60 once the sorting tray case 60 is raised or lowered relative to the parallel sides 61. In the counter balanced double unit case the two sides are moved up and down by chains or the like driven by a motor and worm gear over a sprocket.

Figure 9:
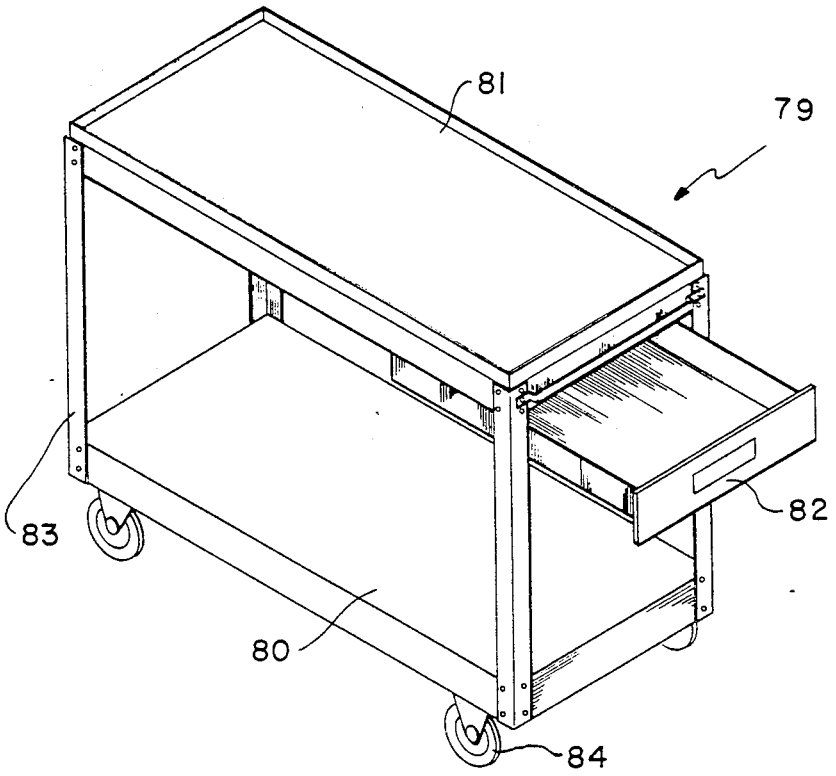
FIG. 9 is a perspective view of the casing cart of the present invention.
Figure 10:
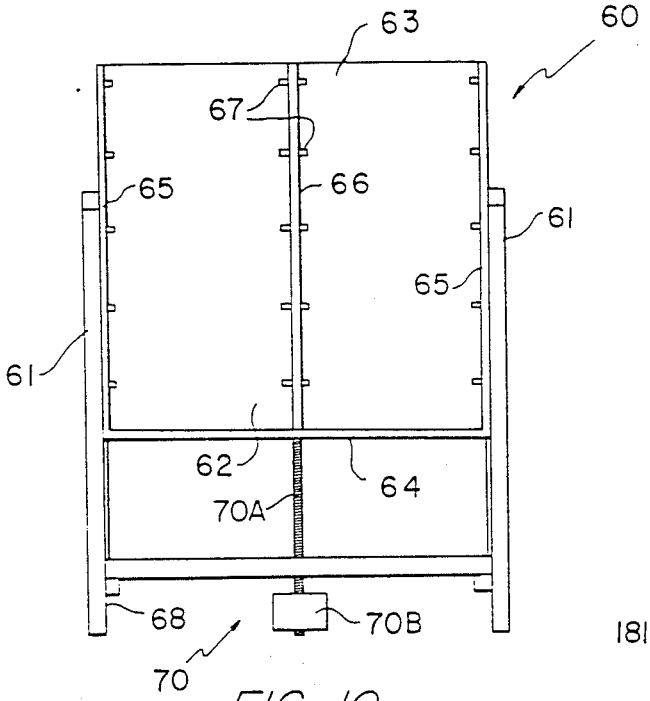
FIG. 10 is a front view of a sorting tray case of the present invention.

Once loaded with empty trays, the cabinet 62 with the portable trays is raised to an upper position, or both side level positions may be moved in the case of the dual unit case which places the shelves at a comfortable reach and to eye level for the sorting of mail. Within the concept of the system of this invention, unsorted mail is brought to the tray case 60 on a casing cart 79 such as illustrated in FIG. 9. The casing cart 79 includes a lower shelf 80 and an upper work surface area 81. A drawer means 82 is provided under the upper work surface area 81, vertical columns 83 separate and space apart the lower shelf 80 from the work surface 81. Roller means 84 are provided to give mobility to the cart. The drawer 82 serves the function of holding carriers, work papers, or any other papers necessary for routing mail or packages or similar materials. It is preferred that the casing cart 79 is dimensioned or sized to comfortably fit across the front of the sorting cabinet at a level just below the bottom most portion of the portable trays and to provide a convenient work surface that does not cause strain when the delivery person reaches over the table to sort mail. In an alternative embodiment, the casing cart 79 can be positioned to fit perpendicularly to the sorting tray case 60 and thereby not cause the delivery person to lean over the casing cart 79.

The casing cart 79, although extremely useful, is not an essential portion of the total system. As the postal service mechanizes to a further and further degree, it is contemplated that an automatic sorting device can directly sort mail into the pockets of the portable tray while it is mounted in a sorting tray case 60 or its equivalent support structure which would hold a plurality of the portable trays 10 during a sorting operation.

Figure 12:
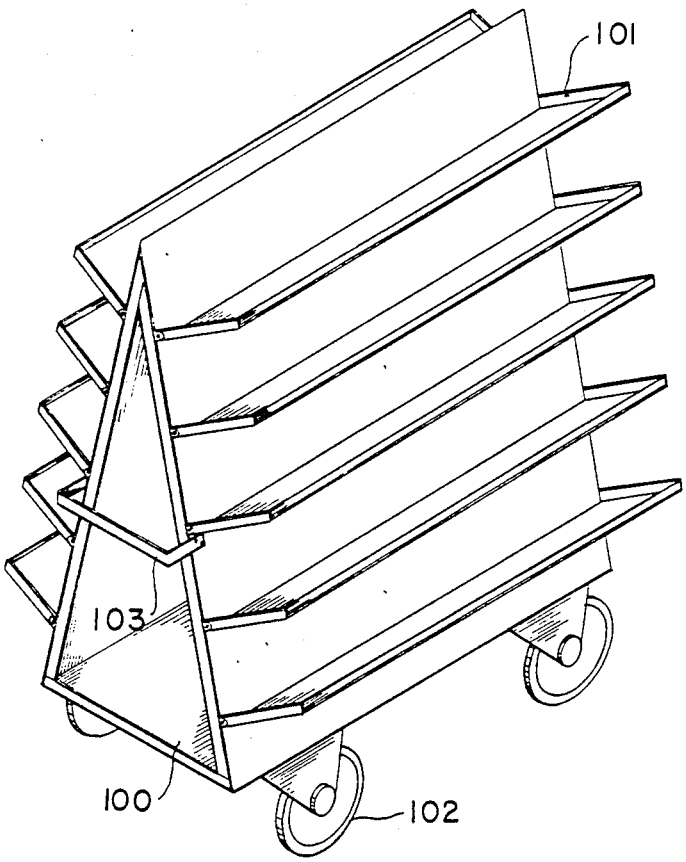
FIG. 12 is a perspective view of the transportation cart of the present invention.

Once the mail is sorted into the portable trays 10, they are removed from the sorting tray case 60 and transported to the delivery vehicle. As illustrated in FIG. 12, a transportation cart 100 is provided for this purpose. The transportation cart 100 includes a plurality of holder means 101 for holding individual portable trays. Preferably five holder means 101 are positioned on each side of the transport cart 100. Roller means or wheels 102 for mobility together with a locking mechanism are provided under the transportation cart 100. A handle 103 is mounted on one side of the transportation cart 100. It is preferred that the holder means 101 include a lip or detent so that the bottom of the postal tray 10 is held in place and will not accidentally be dislodged during the normal movement of transportation carts 100. The transportation cart 100 includes an open area between the two sides containing the folding shelves for placing parcels and for transporting trays. It is recognized that as the Postal System modernizes, equivalent means to the transportation cart 100, such as conveyors or automatic caddy's running on trolleys or tracks, may also be provided for unloading and transporting trays from the sorting case to a delivery means. Further, the transportation cart 100 may be used to transport portable trays 10 from one delivery means to another delivery means. In the alternative, the transportation cart 100 may move trays 10 within a large business location for delivery of mail to addressees within the business location.

Figure 13:
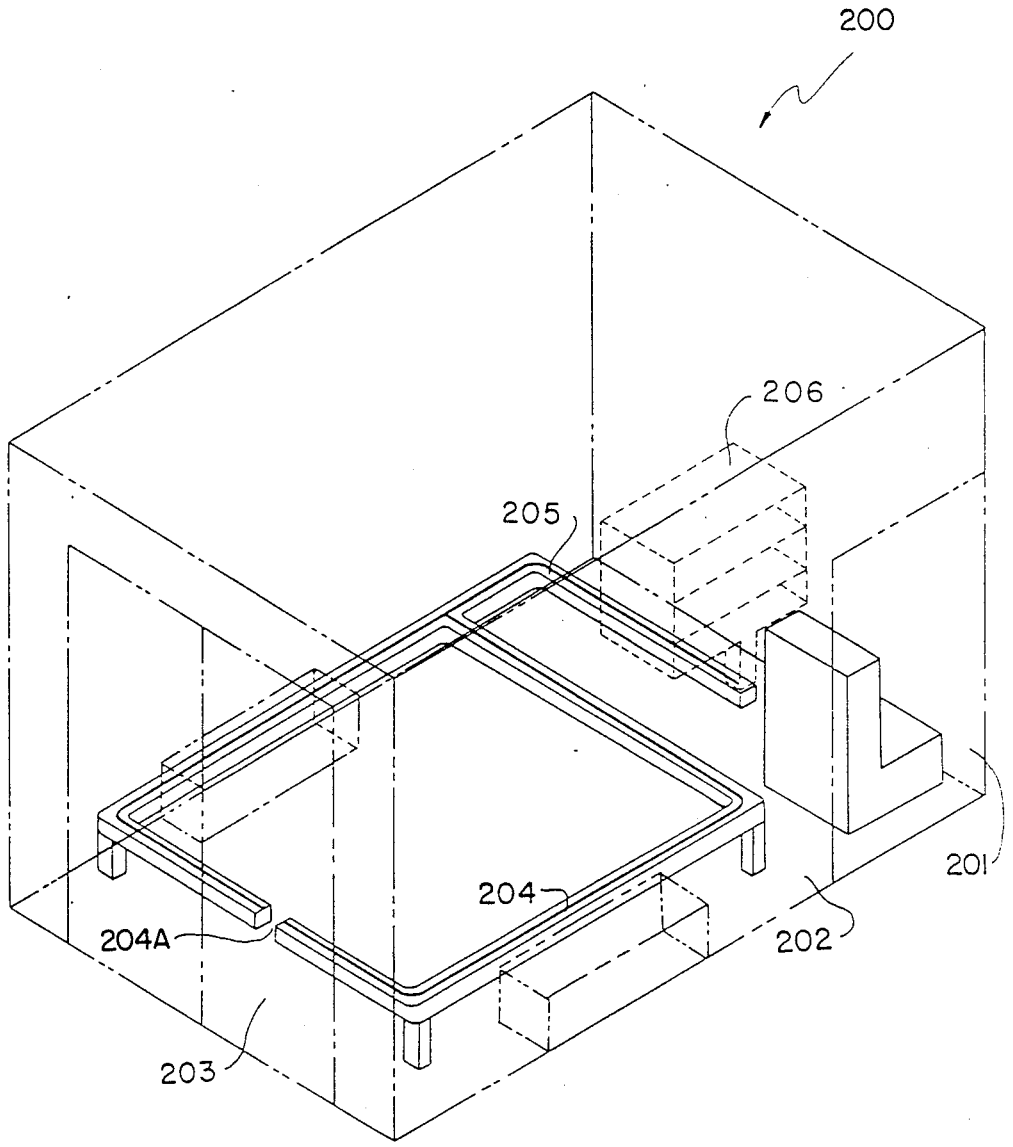
FIG. 13 is a perspective view of the track means of the present invention in place in a delivery vehicle.

The delivery means, illustrated in FIG. 13, is a delivery van, jeep, or other vehicle 200. The vehicle 200 is provided with an operator's area 201 and a storage area 202. Doors or other access means 203 are also provided adjacent to the storage area 202 of the delivery van or vehicle 200. A track 204 is provided which circumscribes the interior of the storage area 202. The track 204 includes an extension 205 which extends into the operator's area 201. A portable tray rack 206 is illustrated in dotted lines. A central area is provided within the track 204 for storing parcels.

Figure 14:
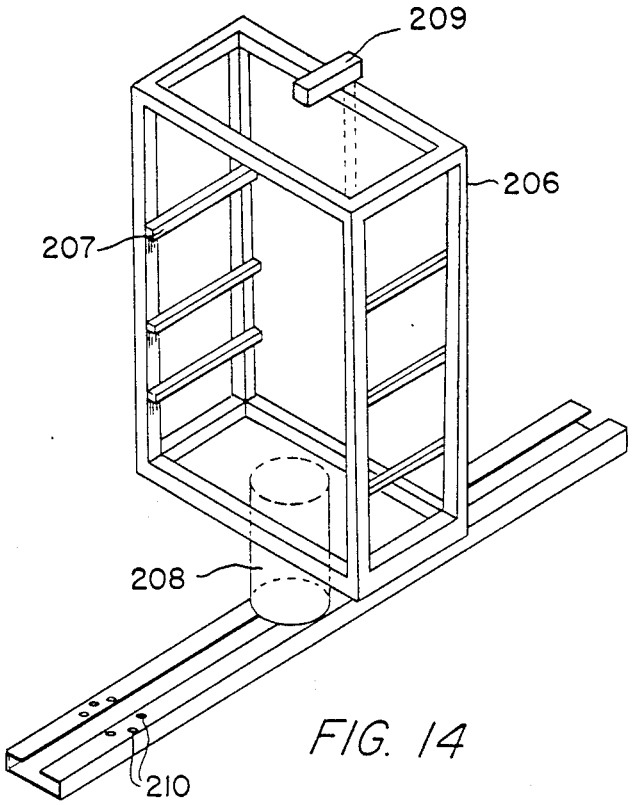
FIG. 14 is a detailed view showing the tray rack of the present invention mounted on the track of the present invention.

As illustrated in FIG. 14, the van rack 206 is mounted on a movable member 208. The movable member 208 is attached rigidly to the van rack 206 and slidably attached to the track mechanism 204. Any one of the numerous track or trolley systems well known in the art an be used, such as a roller bearing illustrated in FIG. 15. The van rack 206 is provided with a plurality, preferably at least three holders 207 for supporting a postal tray 10. The slides 207 are identical to slides 67 in case 60 and effectively lock the tray 10 in place. The holders 207 permit the postal tray 10 to slide therein and to drop down slightly so that the postal tray 10 will not slide out of the van rack 206 during movement of the vehicle 200. The holders 207 match with the slides on the trays 10, for loading the trays in place and preventing dislodging of the trays 10. It is preferred that the van rack 206 is mounted in such a way on the movable member 208 so that it can be rotated or swiveled as it is moved about the vehicle 200. In additional, an access port is provided for routine maintenance.

The track mechanism 204 has a unique shape for moving the van rack 206 containing the trays 10 from the storage area 202 to the operator's area 201. The track mechanism 204 includes an access port 204A to permit easy replacement of selected rollers as the rollers become worn.

In operation, a van rack 206 is moved to the doors 203 at the back of the vehicle 200. At least three portable trays 10 are loaded into the rack 206 in the order in which the deliveries will occur. When the first rack 206 is full, it is moved out of the way to a storage position and a second rack 206 is brought into position. This operation is continued until all of the postal trays 10 necessary to service the particular delivery route have been loaded into the van 200. Once on the route, the tray racks are slid either manually or by a powered trolley mechanism. The tray rack 206 is brought from the storage position 202 to the operating area 201. The rack 206 is moved immediately next to the carrier. The carrier removes the mail and places it in the postal patrons receptacle. When the postal trays 10 are emptied, the tray rack 206 slides back to the storage area 202 and the next van rack 206 in order is brought into the operators area 201. By this operation, the operator does not have to do unnecessary bending or twisting. Minimal movement is necessary for the operator to reach into the portable tray 10 and pull out mail or the like for delivery.

There are occasions when it is necessary for the delivery person to dismount for walking a portion of the route or a loop. The system of this invention provides a collapsible walking cart adapter 300 for taking the postal trays 10 on the walking portion of the route. It is contemplated that an adapter frame 301 includes two arms 302 and 303 is mounted on the frame adjacent the central bar 304 of a three wheel collapsible walking cart 300. The arms 303 have fold down holder means 305 of the same type used in the transport cart so that a plurality, preferably four, of the trays can be mounted on the walking cart 300 and taken on a walking route. The holder means 305 include a lip on the front and sides thereof for retaining the trays 10.

Figure 15:
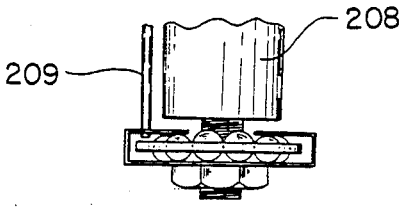
FIG. 15 is a detailed view showing one mechanism for slidably mounting the moving means of the present invention.
Figure 16:
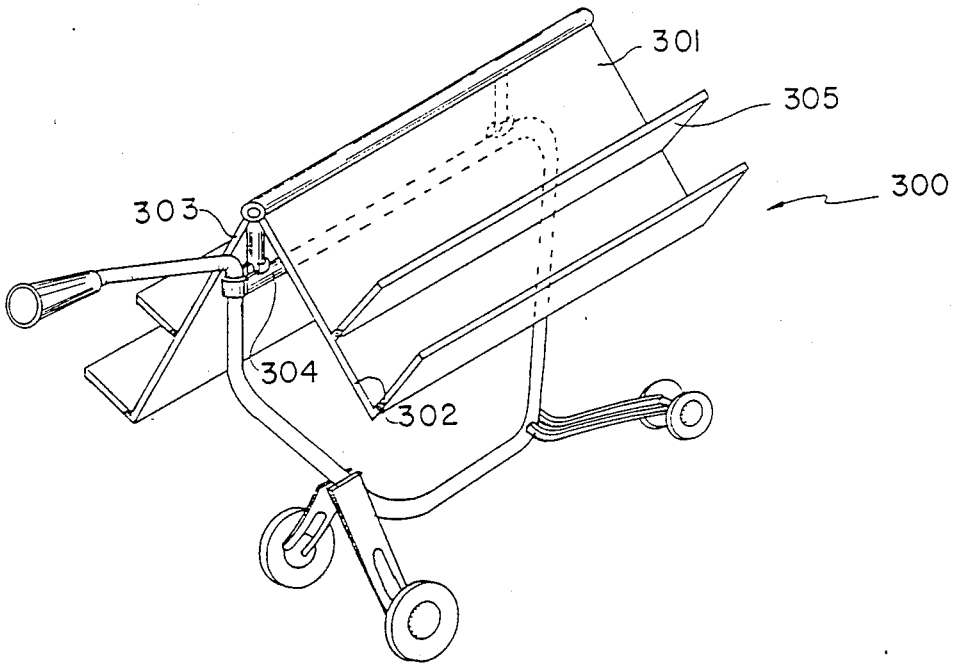
FIG. 16 shows the portable collapsible cart of the present invention with the tray frame mounted upon it.
Figure 17:
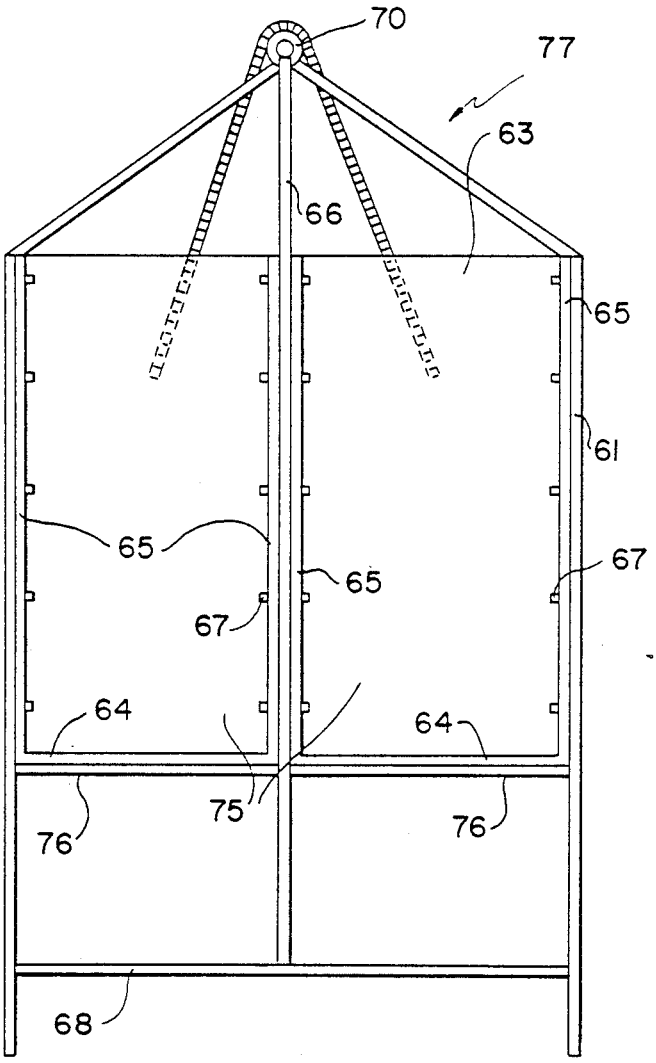
FIG. 17 is a front elevational view of a counter balanced tray case.
Figure 18:
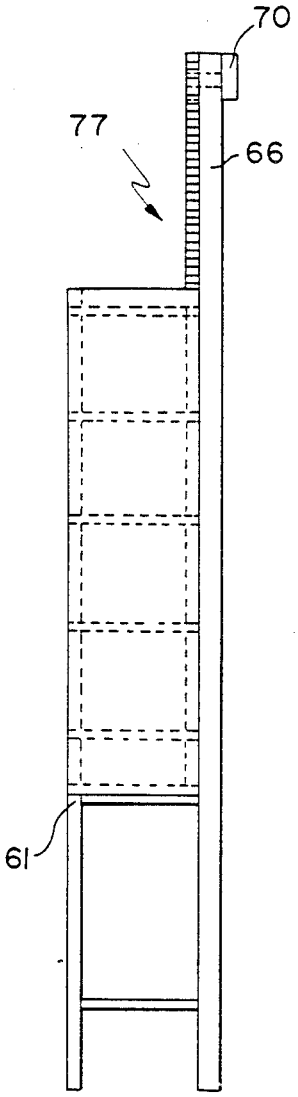
FIG. 18 is a side elevational view of a counter balanced tray case.

As illustrated in FIGS. 14 and 15, the van rack 206 includes a spring release locking mechanism 209 affixed thereto. The locking mechanism 209 is designed to be selectively positioned into one of a series of holes 210 disposed at spaced locations through and along the track mechanism 204. The van rack 206 can be rotated to a preferred position around a 360 degree circle and locked by utilizing the spring release locking mechanism 209.

The tray 10 is designed with the purpose that eventually the storing function will be entirely automated. It can easily be adapted to mount the tray 10 relative to new automated sorting equipment that may be developed by carrier companies in the future. The use of the tray 10 produces a substantial time savings over the current manual system.

The tray 10 together with the sorting tray case 60 reduces the learning time for carriers on new routes and makes the casing of mail by substitutes easier. Further, the present invention eliminate the need to finger mail.

The slide bars 19 are equal in length for providing a safety or locked position when the tray 10 is positioned in either the case 60 or the van rack 206.

The system according to the present invention provides for the movement and portability of the trays 10. The system allows more mail to be sorted and delivered by one carrier. In the alternative, the same volume of mail may be sorted and delivered by fewer carriers. Thus, mail can be efficiently moved from a main postal station to the ultimate address.

The sorting tray case 60 may be mounted on industrial wheels for facilitating the movement of the sorting tray case 60. Further, locking members can be secured to the wheels for fixing the location of the sorting tray case 60. Similarly, locking members can be secured to the wheels 84 of the casing cart 79.

From the invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A mail delivery system comprising:

a plurality of portable trays each tray having a bottom, an open top, at least two rigid oppositely disposed sides affixed to said bottom, at least one open side, gate means disposed to selectively open and close said open side, separators removably attached to at least said bottom, regularly spaced slots within said bottom to receive said separators and at least one set of handle means to assist in the transportation of said portable tray and to assist in the withdrawal or insertion of said portable tray from holder means arranged to receive said tray, said gate means extending from a lower storage position adjacent to said bottom in an inoperative mode for enabling free access to said open side to an upper retention position adjacent to substantially a midpoint of said side walls in an operative mode for preventing mail from being accidentally dislodged from said tray;

a tray case containing a plurality of holder means for removably receiving a plurality of said portable trays, means for raising and lowering said tray case and said portable trays from a loading position to a sorting position;

transport means containing a plurality of holder means for receiving said portable trays and transporting said portable trays from said tray cases to a tray rack in a delivery means;

said delivery means comprising a control center and a storage center, said control and storage centers provided with a track means circumscribing the interior of said storage center and extending into said control center, at least one tray rack, said tray rack containing a plurality of holder means adapted to removably receive said portable trays, moving means attached to said rack and movably mounted on said track to permit movement of said tray rack from a loading position to a storage position in the storage center and to a delivery position in said control center, stop means releasably holding said tray rack at positions in said track means and access means in said storage center for loading and unloading said portable trays to said tray rack.

2. A mail delivery system according to claim 1, and further including a casing cart adapted to align with said adjustable tray case to assist in sorting and casing mail into said portable trays when said trays are in said sorting position.

3. A mail delivery system according to claim 1, and further including a walking cart having a plurality of holder means mounted thereon adapting said walking cart to transport a plurality of said portable trays from said delivery means to delivery locations.

4. A mail delivery system according to claim 2, and further including a walking cart having a plurality of holder means mounted thereon adapting said cart to transport a plurality of said portable trays from said delivery means to delivery locations.

5. A mail delivery vehicle having a control center, a storage center, a track means circumscribing the interior of said storage center and extending into said control center, at least one portable tray, said tray having an open top, at least two rigid side walls and at least one open side, a gate means for selectively opening and closing said open side, said gate means extending from a lower storage position adjacent to said bottom in an inoperative mode for enabling free access to said open side to an upper retention position adjacent to substantially a midpoint of said side walls in an operative mode for preventing mail from being accidentally dislodged from said tray;

at least one tray rack, said tray rack containing a plurality of holder means for receiving and holding said portable trays, moving means attached to said tray rack and movably mounted on said track to permit movement of said rack from a loading position to a storage position in the storage center and to a delivery position in said control center, stop means releasably holding said tray rack at positions in said track means, and access means in said storage center for loading and unloading said portable trays to said tray rack, said loading position being adjacent said access means.

* * * * *